US008448588B1

(12) United States Patent
Lindley

(10) Patent No.: US 8,448,588 B1
(45) Date of Patent: May 28, 2013

(54) FORCE SENSING DEVICE ADAPTED FOR SENSING THREAD TENSION IN A LONG-ARM OR MID-ARM SEWING MACHINE

(76) Inventor: Leonard Samuel Lindley, Saint George, UT (US)

( * ) Notice: Subject to any disclaimer, the term of this patent is extended or adjusted under 35 U.S.C. 154(b) by 0 days.

(21) Appl. No.: 13/588,358

(22) Filed: Aug. 17, 2012

Related U.S. Application Data

(60) Provisional application No. 61/525,050, filed on Aug. 18, 2011.

(51) Int. Cl.
*D05B 47/00* (2006.01)

(52) U.S. Cl.
USPC ..... 112/254

(58) Field of Classification Search
USPC ..... 112/254, 255, 278, 470.01; 73/159, 73/160, 862.42, 862.474, 862.473, 862.471, 73/862.381, 862.391
See application file for complete search history.

(56) References Cited

U.S. PATENT DOCUMENTS

| | | | | |
|---|---|---|---|---|
| 1,084,736 | A | | 1/1914 | Hagelstein |
| 3,613,610 | A | | 10/1971 | Hinerfield et al. |
| 3,618,541 | A | | 11/1971 | Shryock |
| 3,785,308 | A | | 1/1974 | Brandriff et al. |
| 3,927,631 | A | | 12/1975 | Kuhar et al. |
| 4,100,865 | A | | 7/1978 | Landau et al. |
| 4,138,885 | A | | 2/1979 | Moore |
| 4,166,423 | A | | 9/1979 | Brienza et al. |
| 4,236,467 | A | | 12/1980 | Tanaka et al. |
| 4,280,423 | A | | 7/1981 | Goncharko |
| 4,289,087 | A | | 9/1981 | Takenoya et al. |
| 4,292,905 | A | | 10/1981 | Widmer et al. |
| 4,301,757 | A | | 11/1981 | Tonomura et al. |
| 4,308,814 | A | | 1/1982 | Takenoya |
| 4,328,757 | A | | 5/1982 | Inaba et al. |
| 4,377,980 | A | | 3/1983 | Hanyu et al. |
| 4,458,613 | A | | 7/1984 | Eguchi et al. |
| 4,565,143 | A | | 1/1986 | Hanyu et al. |
| 4,660,481 | A | | 4/1987 | Spickermann |
| 4,667,614 | A | | 5/1987 | Hangarter et al. |
| 4,691,648 | A | | 9/1987 | Hirose |
| 4,704,974 | A | | 11/1987 | Herdeg et al. |
| 4,768,450 | A | | 9/1988 | Kato et al. |
| 4,793,273 | A | | 12/1988 | Hara et al. |
| 4,811,673 | A | | 3/1989 | Yoshida |
| 4,884,763 | A | * | 12/1989 | Rydborn ..... 242/148 |
| 4,899,678 | A | | 2/1990 | Simons |
| 5,033,400 | A | * | 7/1991 | Fischer ..... 112/254 |
| 5,199,365 | A | | 4/1993 | Arnold |
| 5,249,538 | A | | 10/1993 | Nakano |

(Continued)

*Primary Examiner* — Nathan Durham
(74) *Attorney, Agent, or Firm* — Plager Schack LLP

(57) ABSTRACT

A force sensing device is adapted for sensing thread tension in a long-arm or mid-arm sewing machine. The force sensing device comprises the sewing machine mechanically coupled to a force sensor disk. A user can rotate a tension adjuster knob to increase or decrease thread tension as necessary. The force sensor disk comprises a variable resister that is electrically coupled to a force sensor disk cable; the force sensor disk cable is electrically coupled to a measurement resistor RM, a load resistor RL, a battery and a power switch. As the tension on the force sensor disk increases, the resistance on force sensor disk decreases and voltage across measurement sensor RM increases. A digital readout meter measures the voltage proportional to the tension on the force sensor disk. A voltage relative to tension is displayed on a display screen and can be viewed by the user who can increase or decrease the tension as necessary.

3 Claims, 2 Drawing Sheets

U.S. PATENT DOCUMENTS

| | | | | |
|---|---|---|---|---|
| 5,389,868 | A | 2/1995 | Mikami et al. | |
| 5,390,126 | A | 2/1995 | Kongho | |
| 5,680,827 | A | 10/1997 | Sakanobe et al. | |
| 5,711,238 | A | 1/1998 | Matsuo et al. | |
| 5,806,448 | A | 9/1998 | Matsuo et al. | |
| 6,321,671 | B1 | 11/2001 | Tomita | |
| 6,430,460 | B1 | 8/2002 | Taguchi | |
| 6,595,150 | B2 * | 7/2003 | Yamazaki | 112/254 |
| 7,124,697 | B2 * | 10/2006 | Foley | 112/255 |
| 7,370,592 | B2 | 5/2008 | Tajima et al. | |
| 7,536,963 | B2 | 5/2009 | Durville et al. | |
| 7,806,063 | B2 | 10/2010 | Shimizu | |
| 2004/0000262 | A1 | 1/2004 | Sakakibara | |
| 2006/0107883 | A1 | 5/2006 | Terao et al. | |
| 2007/0144417 | A1 | 6/2007 | Watanabe | |
| 2010/0199902 | A1 | 8/2010 | Mori et al. | |
| 2012/0109357 | A1 | 5/2012 | Okuyama | |

* cited by examiner

FORCE SENSING DEVICE ADAPTED FOR SENSING THREAD TENSION IN A LONG-ARM OR MID-ARM SEWING MACHINE

CROSS REFERENCE TO RELATED APPLICATIONS

This application claims priority to U.S. Provisional Patent Application 61/525,050 filed on Aug. 18, 2011.

FIELD OF THE INVENTION

This invention relates to tension mechanisms for needle-thread in a sewing machine.

BACKGROUND OF THE INVENTION

There are four things which seem to primarily affect the stitch quality: the tension, the needle, whether you have correctly threaded the machine, and the thread. The present invention is concerned with the tension of the thread. In general, the thicker the fabric, higher the tension must be to lift the lower thread up to the middle of the layers of fabric. Having an incorrect tension leads to a poor quality stitch. The prior art teaches three general techniques for determining tension.

U.S. Pat. No. 7,124,697 issued to Foley teaches a digital thread tension monitoring and control device involving a pair of control discs and are separated by a helical spring, as the discs move closer or further the spring expands or contracts and that determines the tension in the thread. The "helical spring" method has been around for a long time and is popular with undergraduate researchers because the physics make for a simple calculation. As the spring is compressed the device reads the compression and correlates that to an average force. The difficulty is that it is not very accurate, with values ranging +/−2 Newtons in recent studies. For example, Carvalho, et al. Adaptive Control of an Electromagnetically Presser-Foot for Industrial Sewing (available at http://repositorium.sdum.uminho.pt/bitstream/1822/10905/1/ETFA2010_HelderCarvalho.pdf). Efforts to make these systems more accurate are in progress.

U.S. Pat. No. 6,595,150 issued to Yamazaki teaches a thread tension control device utilizing a pneumatic cylinder between a pair of control discs. This system teaches away from the current device and was designed to regulate tension in thread as opposed to displaying the tension.

U.S. Patent Application 2004/0000262 filed by Sakakibara teaches a device that measures the angle of the needle to determine and correct tension between the control discs. Like Yamizaki, no theory is offered on how to measure the tension between the thread discs.

BRIEF SUMMARY OF THE INVENTION

A force sensing device is adapted for sensing thread tension in a long-arm or mid-arm sewing machine. The force sensing device comprises the sewing machine mechanically coupled to a force sensor disk. A user can rotate a tension adjuster knob to increase or decrease thread tension as necessary. The force sensor disk comprises a variable resister that is electrically coupled to a force sensor disk cable; the force sensor disk cable is electrically coupled to a measurement resistor RM, a load resistor RL, a battery and a power switch. As the tension on the force sensor disk increases, resistance increase and current across measurement sensor RM decreases; a digital readout meter determines the tension on the force sensor disk. The tension is displayed on a display screen and can be viewed by the user who can increase or decrease the tension as necessary.

BRIEF DESCRIPTION OF THE SEVERAL VIEWS OF THE DRAWINGS

Figure 1:
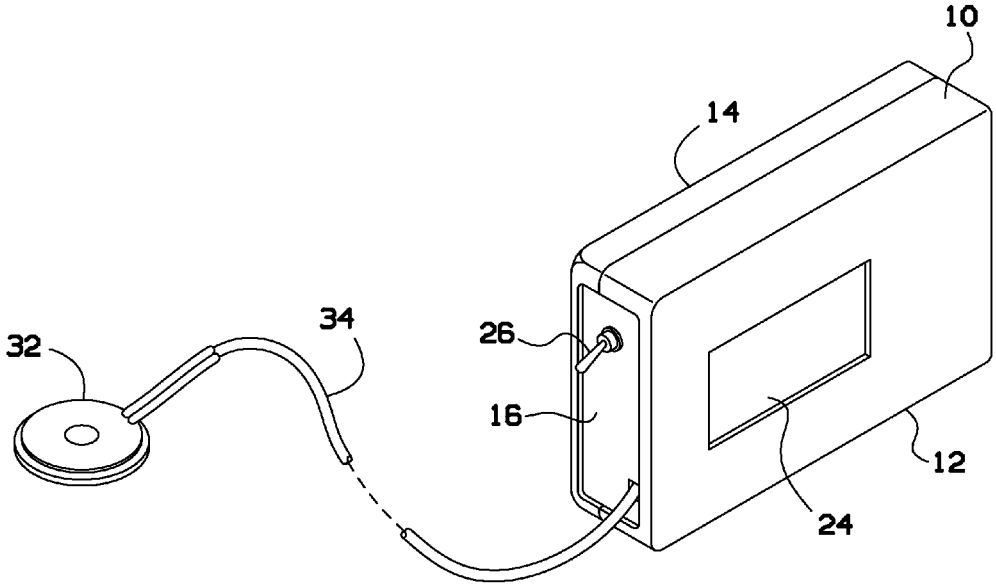

Having thus described the invention in general terms, reference will now be made to the accompanying drawings, which are not necessarily drawn to scale, and wherein:

FIG. 1 is a perspective view of the invention.

Figure 2:
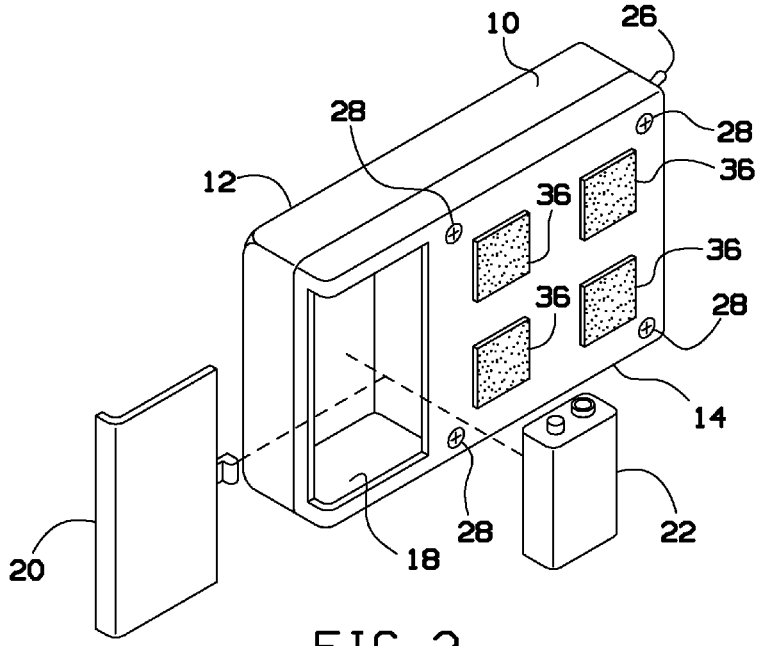

FIG. 2 is a perspective rear view of the invention showing a battery being installed with the force sensor disk and the force sensor disk cable removed for clarity.

Figure 3:
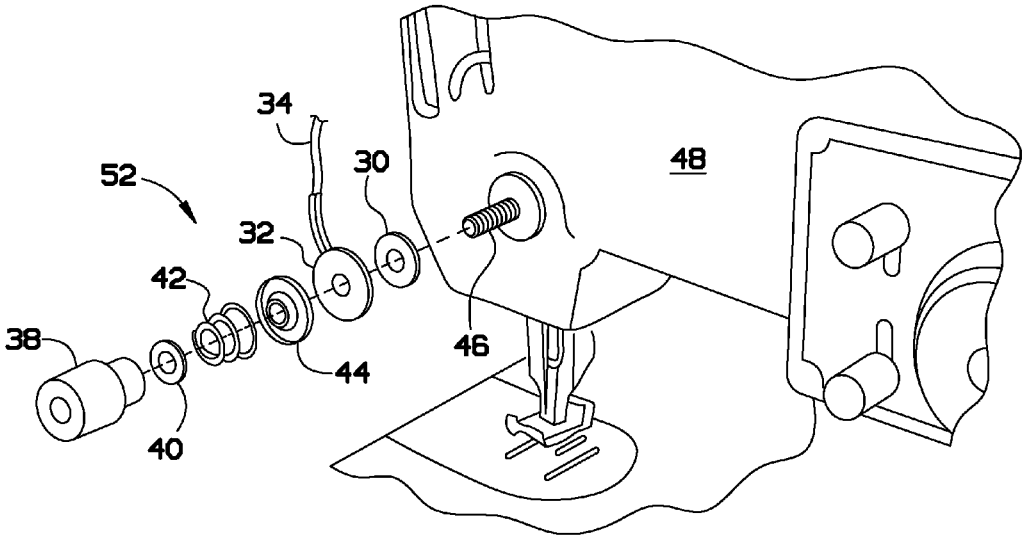

FIG. 3 is a detailed perspective view of the sewing machine tension guide assembly showing the force sensor disk being installed.

Figure 4:
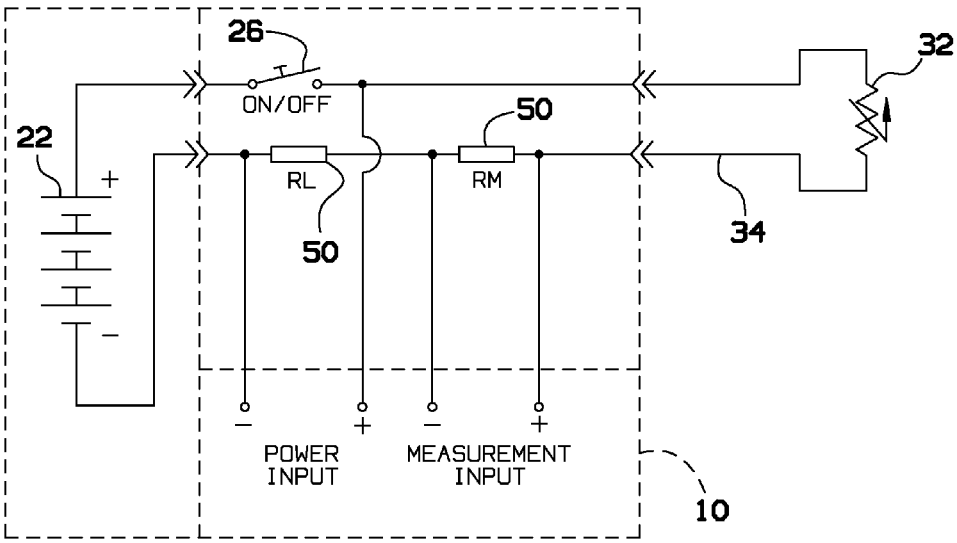

FIG. 4 is an electrical schematic of the invention.

DETAILED DESCRIPTION OF THE INVENTION

Embodiments of the present invention overcome many of the obstacles associated with discerning the tension of thread in a sewing machine, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a perspective view of the force sensing device. Digital readout meter 10 comprises front panel 12 mechanically coupled to back panel 14. Front panel 12 and back panel 14 are mechanically coupled to side panel 16. Back panel 14 is shown in more detail in FIG. 2. Front panel 12 and back panel 14 are both mechanically coupled to side panel 16. Side panel 16 further comprises power switch 26. Front panel 12 further comprises display screen 24. In the preferred embodiment display screen 24 is a liquid crystal display or a light emitting diode that can be easily seen by a user. Digital readout meter 10 is mechanically coupled to force sensor disk 32 by force sensor disk cable 34.

FIG. 2 shows panel 14 in more detail. Back panel 14 is mechanically coupled to front panel 12 by screws 28. Battery 22 can be inserted into battery compartment 18 which is sealed by battery door 20. Battery 22 is electrically coupled to force sensor disk 32 as shown in more detail in FIG. 4. Back panel 14 can be affixed to sewing machine 48 with hook and loop fastener 36.

Sewing machine 48 is a long-arm or mid-arm sewing machine. Here, a long-arm or mid-arm sewing machine is a sewing machine that has a stitching capacity of 12 inches or more. Sewing machine 48 is mechanically coupled to tension adjuster threaded post 46 in a well-known manner. Tension adjuster threaded post 46 is immediately adjacent to washer 30, force sensor disk 32, tension spring washer 44, tension spring 42, outer washer 40 and tension adjusting knob 38. In this manner a user can rotate tension adjusting knob 38 to compress tension spring 42 against tension spring washer 44 which compresses force sensor disk 32 and rotates around tension adjuster threaded post 46 to increase or decrease thread tension as necessary.

Here is a deviation from the prior art, Foley Sakakibara and Yamizaki teach that a computer circuit knows better than a seamstress as to increase and decrease tension. As a practical matter, few have purchased the Foley Sakakibara and Yamizaki devices because thread tension is one of a number of factors that can affect a stitch. The skilled seamstress needs to know the tension in the thread, but may not need to correct it in the mechanical manner suggested by the prior art.

FIG. 4 shows an electrical schematic of how the force sensing device is used for sensing thread tension. Force sensor disk 32 is a variable resister electrically coupled to measurement resistor RM 50, load resister RL 50 and power switch 26 by force sensor disk cable 34. Measurement resistors are electrically coupled to battery 22 completing the circuit.

As the tension on force sensor disk 32 increases, a force sensor disk resistance decreases and the current across measurement resistor RM 50 increases, producing a corresponding increase in voltage across measurement resistor RM 50. Digital readout meter 10 measures the voltage across measurement resister RM 50, which directly relates to the tension on force sensor disk 32. A tension related voltage is displayed on a display screen is displayed on display 24 and can be viewed by a user who can increase or decrease tension as necessary.

That which is claimed:

1. A force sensing device adapted for sensing thread tension in a long-arm or mid-arm sewing machine, the force sensing device comprising, the sewing machine mechanically coupled to a tension adjuster threaded post; the tension adjuster threaded post is immediately adjacent to a force sensor disk, a tension spring washer, a tension spring and a tension adjusting knob in this manner a user can rotate the tension adjusting knob to compress the tension spring against the tension spring washer which compresses the force sensor disk against the sewing machine to increase or decrease thread tension as necessary;

the force sensor disk comprises a variable resister that is electrically coupled to a force sensor disk cable; the force sensor disk cable is electrically coupled to a measurement resistor RM, a load resistor RL, a battery and a power switch configured to form a force sensing resistor; and in this manner as the tension on the force sensor disk increases, a force sensor disk resistance decreases and voltage across the measurement resistor RM increases; a digital readout meter measures the voltage across measurement resister RM, which directly relates to the tension on the force sensor disk; a tension related voltage is displayed on a display screen and can be viewed by the user who can increase or decrease the tension as necessary.

2. The force sensing device of claim 1, the digital readout meter further comprises a front panel mechanically coupled to a back panel and a side panel by screws; and the force sensing resistor is powered with direct current power and is portable.

3. The force sensing device of claim 1, the digital readout meter further comprises a front panel mechanically coupled to a back panel and a side panel by screws; and the display screen is a liquid crystal display or a light emitting diode display that can be easily seen by the user.

* * * * *